US006110419A

United States Patent [19]

Buckley-Golder et al.

[11] Patent Number: 6,110,419

[45] Date of Patent: Aug. 29, 2000

[54] POINT CONTACT DENSIFICATION

[75] Inventors: Keith Buckley-Golder, Oakville; Peter Jones, Toronto; D. Sarafinchan, Hamilton, all of Canada

[73] Assignee: Stackpole Limited

[21] Appl. No.: 08/982,428

[22] Filed: Dec. 2, 1997

[51] Int. Cl.[7] ..... B21K 1/04

[52] U.S. Cl. ..... 419/28

[58] Field of Search ..... 419/28

[56] References Cited

U.S. PATENT DOCUMENTS

| | | | |
|---|---|---|---|
| 2,692,216 | 10/1954 | Baker | 148/11.5 |
| 3,795,129 | 3/1974 | Goto | 72/342 |
| 3,874,049 | 4/1975 | Ferguson | 29/149.5 DP |
| 4,059,879 | 11/1977 | Chmura et al. | 29/148.4 R |
| 4,232,436 | 11/1980 | Chmura | 29/148.4 B |
| 4,428,778 | 1/1984 | Masuda et al. | 148/11.5 P |
| 5,009,842 | 4/1991 | Hendrickson et al. | 419/28 |
| 5,208,943 | 5/1993 | Marumo et al. | 378/125 |
| 5,248,474 | 9/1993 | Morgan | 419/28 |
| 5,453,242 | 9/1995 | Knoess | 419/27 |
| 5,512,236 | 4/1996 | Jones et al. | 419/28 |
| 5,552,109 | 9/1996 | Shivanath et al. | 419/53 |
| 5,740,516 | 4/1998 | Jiranek, II et al. | 428/553 |

FOREIGN PATENT DOCUMENTS

| | | |
|---|---|---|
| 2641899 | 5/1977 | Germany . |
| WO 94/14557 | 7/1994 | WIPO . |

OTHER PUBLICATIONS

ASM Handbook, vol. 7, Powder Metallurgy, pp. 337–338, 1984.

*Primary Examiner*—Daniel J. Jenkins
*Attorney, Agent, or Firm*—Eugene J. A. Gierczak

[57] ABSTRACT

A method of densifying a sintered powder metal article by point contact.

20 Claims, 17 Drawing Sheets

Figure 17: Typical Densification for 7.00 g/cm$^3$ Core Density
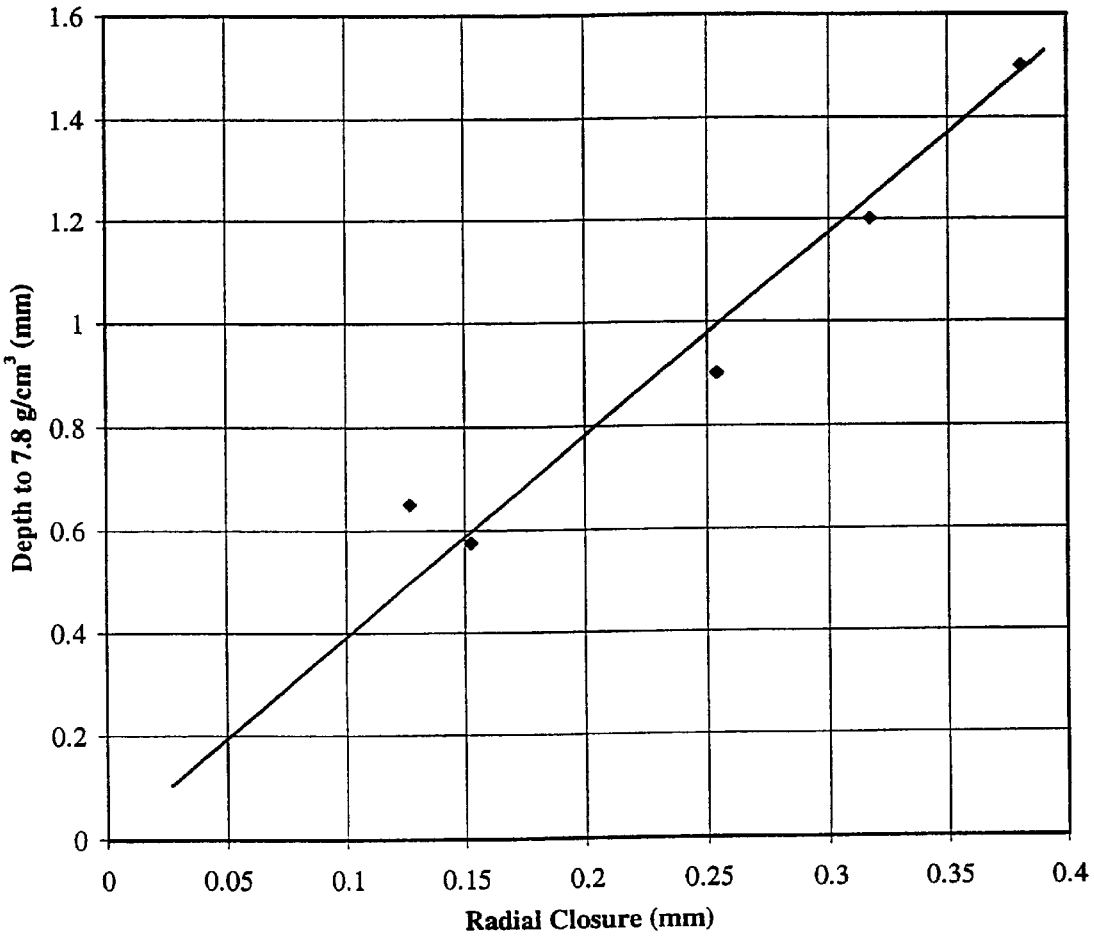

Figure 18: Point Contact Densification Limit Diagram
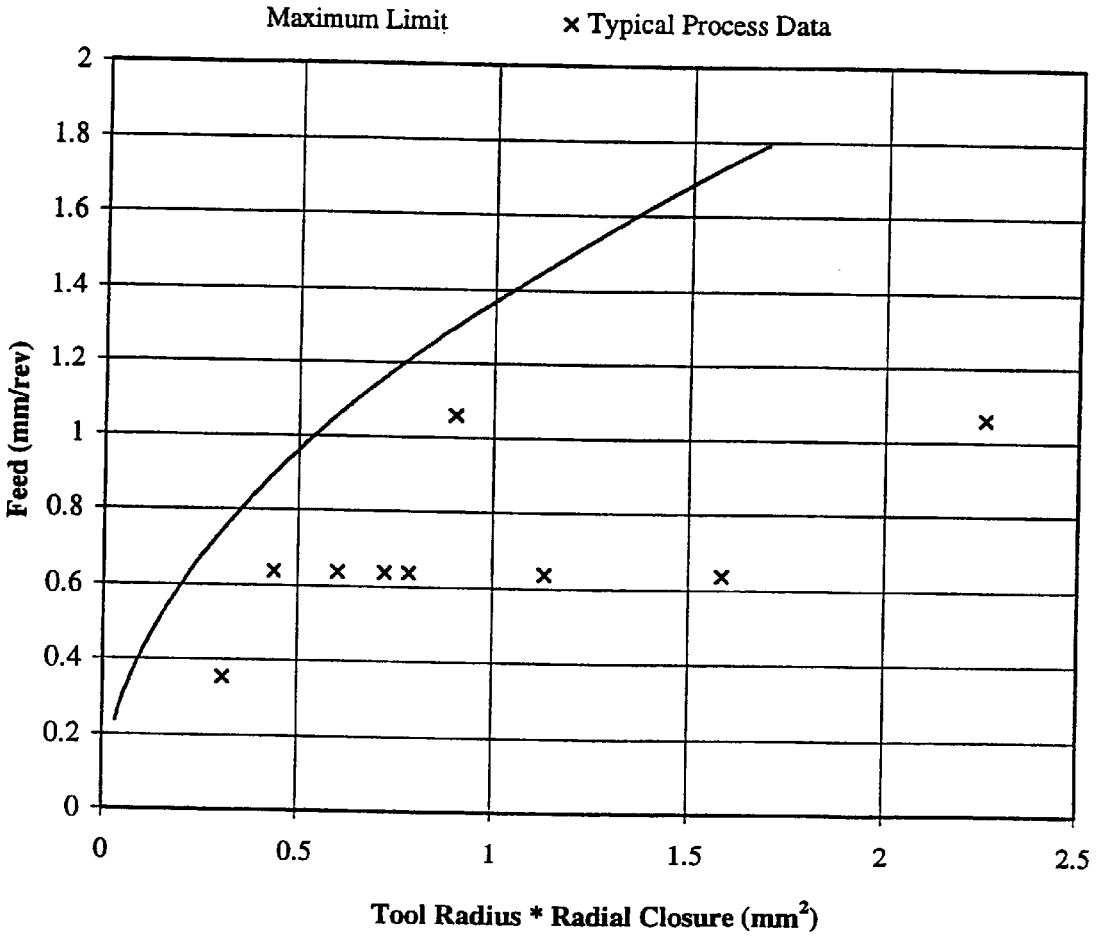
Feed - Lateral displacement per revolution
- displacement per rev. must be smaller than tool's minimum radius
Closure - Radial thickness reduction
Radius - Rolling element minimum radius

POINT CONTACT DENSIFICATION

FIELD OF INVENTION

This invention relates to a method of densifying a sintered powder metal article by point contact and in particular relates to a point contact densification of a sintered powder metal article by pressing and traversing said point across said powder metal article to define a densified surface.

BACKGROUND TO THE INVENTION

Various strides have heretofore made in order to produce high quality sintered powder metal articles whether in the form of gears, backing plates or the like.

Various processes and apparatus have been devised in the prior art so as to increase the density of sintered powder metal article. For example, U.S. Pat. No. 3,795,129 relates to a method of forging a sintered article having a high density which method comprises pre-heating the forging tool of a forging machine and heating a preshaped powdering article and forging said heated preshaped powder article by said pre-heated tool.

U.S. Pat. No. 3,874,049 teaches a method of forming powder metal parts having a bearing surface wherein a sintered preform is cold formed and during such forming, shear forces are applied to the surface of the preform where the bearing surface is desired by causing a moveable die to penetrate and wipe along said surface of the area of the preform.

Moreover, U.S. Pat. No. 4,059,879 relates to a method of partially densifying a selected surface portion of a sintered porous powder metal element while applying restraining pressure to other selected portions of said element in order to inhibit growth and cracking of said element during the partial cold deformation thereof. This method was described in the production of annular bearing rings and specifically required the application of restraining pressure.

Moreover, U.S. Pat. No. 4,428,778 relates to a process for producing metallic chromium sheets from metallic chromium powders comprising a step of rolling metallic chromium powders, a step of sintering rolled sheets thus obtaining a temperature in the range of 900° C. to 1400° C., a step of rerolling the sintered sheets with a reduction range from 5 to 50% and a step of annealing the rerolled sheets.

In many of the prior art processes and apparatus including those described above the surfaces are densified by applying a rolling cylinder or the like against the sintered powder metal article so as to densify the surface. In particular, such prior art devices generally include a "line" of contact between the densifying tool and the sintered powder metal article. More particularly in one arrangement of the prior art the densifying tool is pressed up against the sintered powder metal article which is to be densified such that the axis of rotation of the densifying tool and the rotating sintered powder metal article are generally parallel and the densification occurs along "a line" of contact. Generally speaking since such prior art sintered powder metal article are densified along "line" of contact high densifying forces are required which therefore result in lower tool life.

It is an object of this invention to provide an improved method of densifying a sintered powder metal article.

It is a further aspect of this invention to provide a method of densifying a sintered powder metal article by point contact.

It is yet another aspect of this invention to provide a method of densifying a sintered powder metal article with a tool having a point for pressing and traversing said sintered powder metal article so as to densify the surface of said sintered powder metal article traversed by said point.

It is a further aspect of this invention to provide a method of densifying a sintered powder metal article comprising: blending carbon, alloys and iron; pressing said blends so as to produce a compact; sintering said compact to produce a sintered powder metal article; densifying said sintered powder metal article at ambient temperature by relative motion between said article with the tool having a point for pressing and traversing said article to define a densified surface.

It is another aspect of this invention to produce an apparatus for defining a sintered powder metal article comprising: (a) a tool having a point for contacting said sintered powder metal article; (b) means for generating relative motion between said tool and said articles for pressing said tool into said articles so as to scribe a densified surface unto said sintered powder metal article.

It is another aspect of this invention to produce a tool for densifying a sintered powder metal blank, said tool having an edge for contacting said article at a point.

DRAWINGS

These and other objects and features shall now be described in relation to the following drawings.

Figure 6:
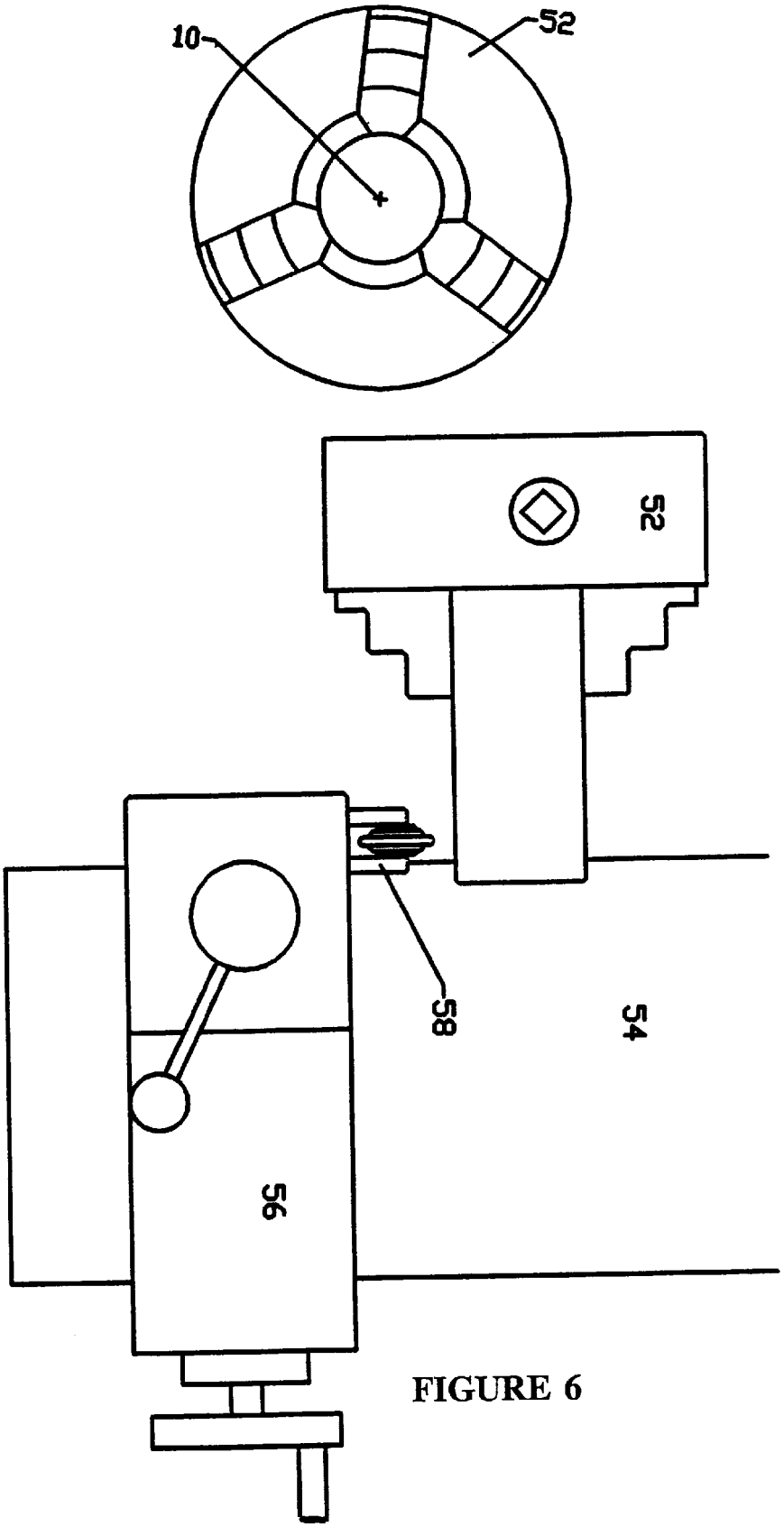
FIG. 6 is a representative view of densifying a sintered powder metal article in a lathe.
Figure 7:
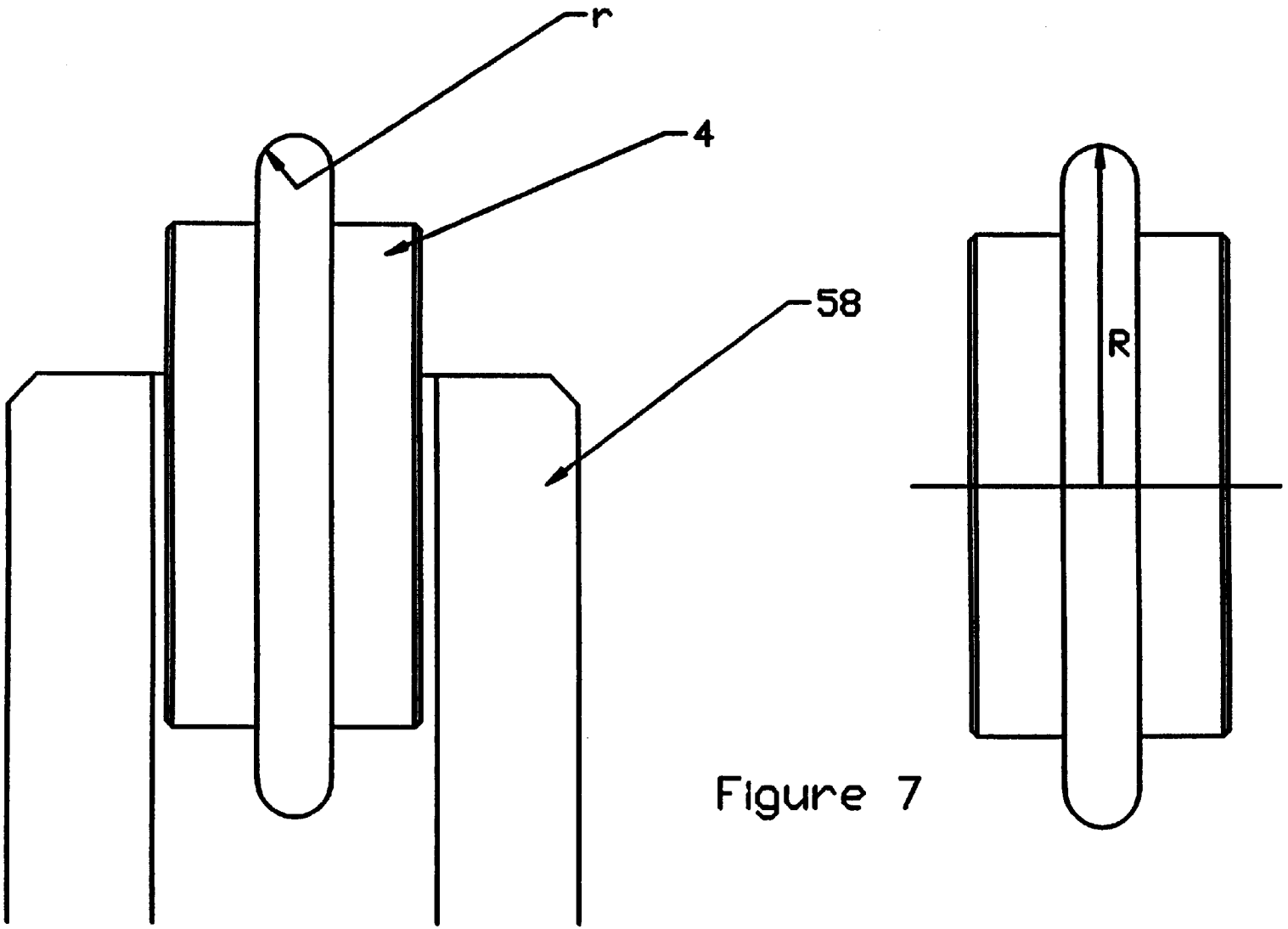
Figure 7A:
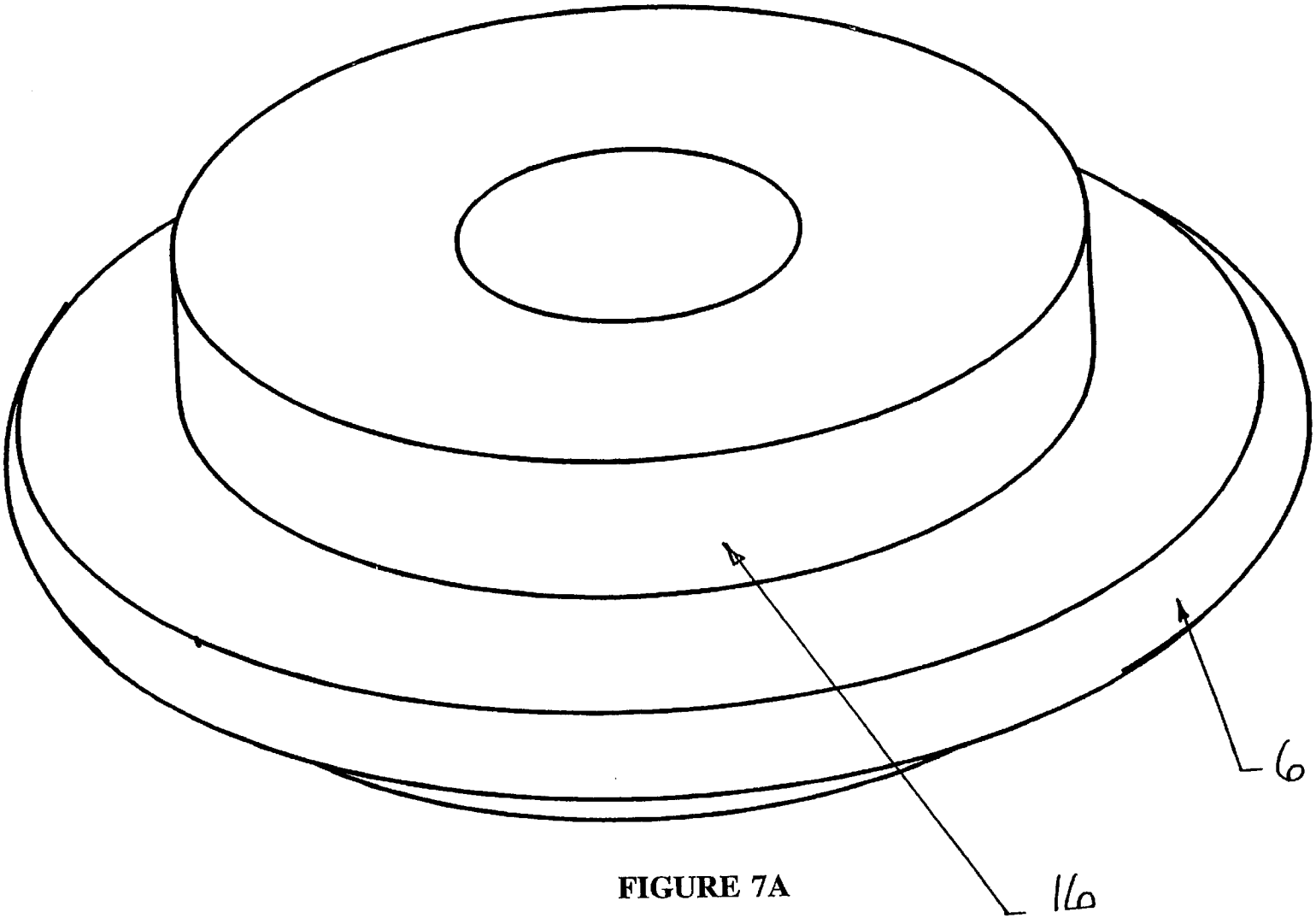

FIGS. 7 and 7*a* is a representative view of the rolling tool used in FIG. 6.

Figure 8:
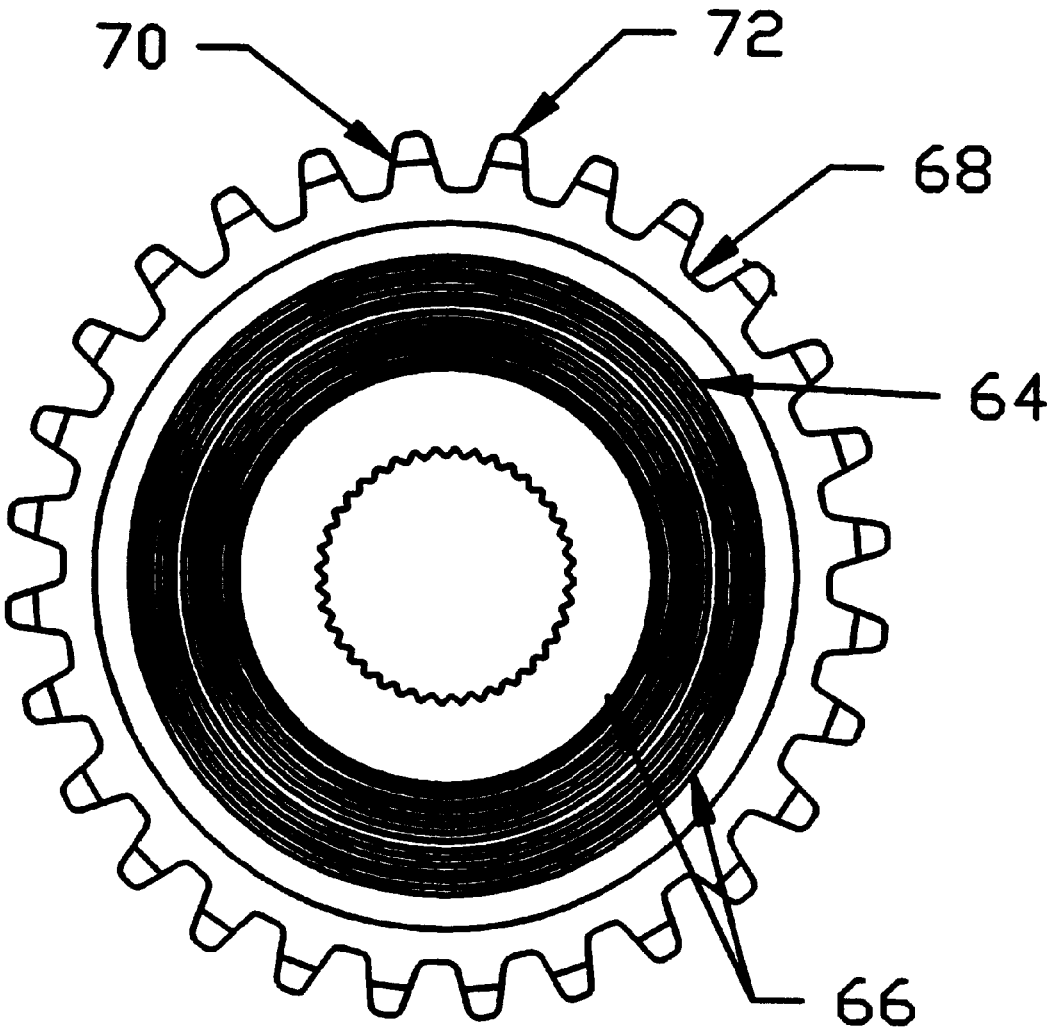

FIG. 8 is a top plan view of a gear illustrating point contact densification along an end of a sintered powder metal blank.

Figure 9:
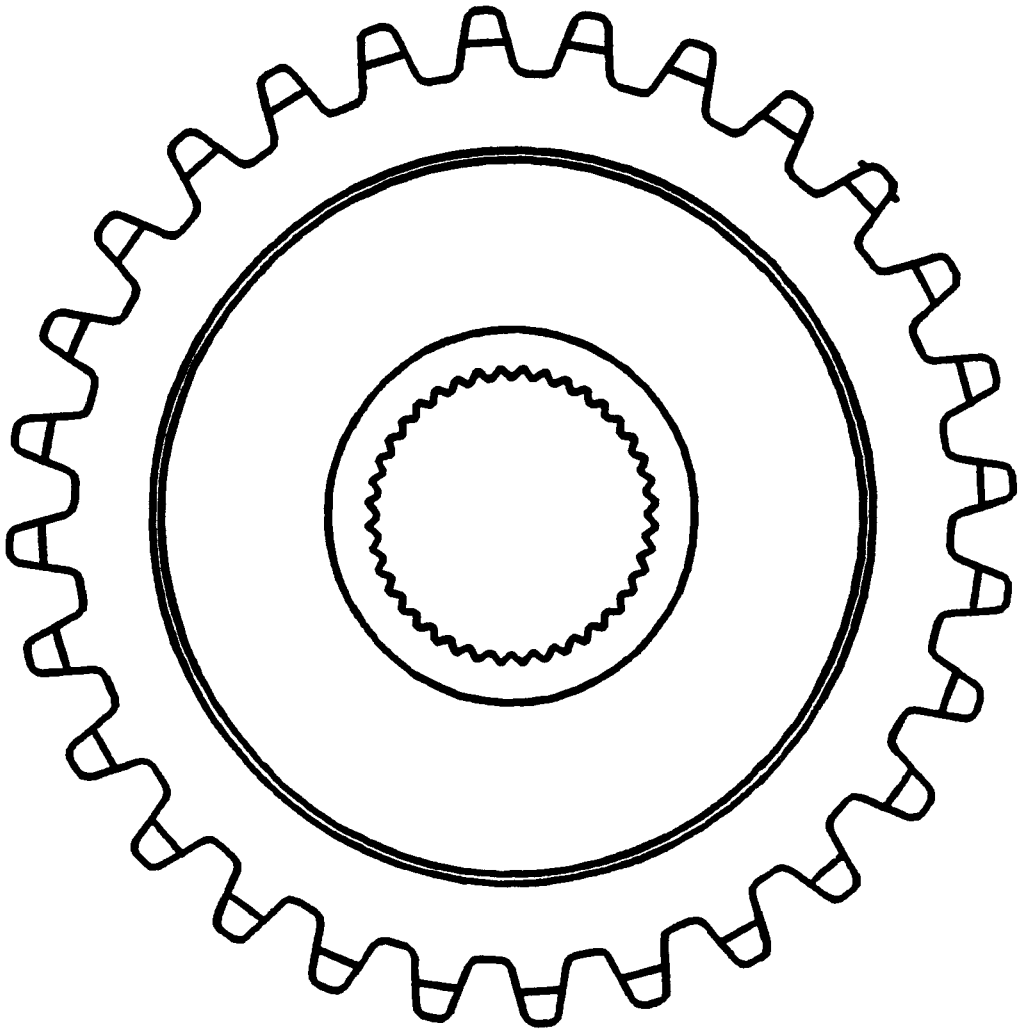

FIG. 9 is a side view of a gear of FIG. 6.

Figure 10:
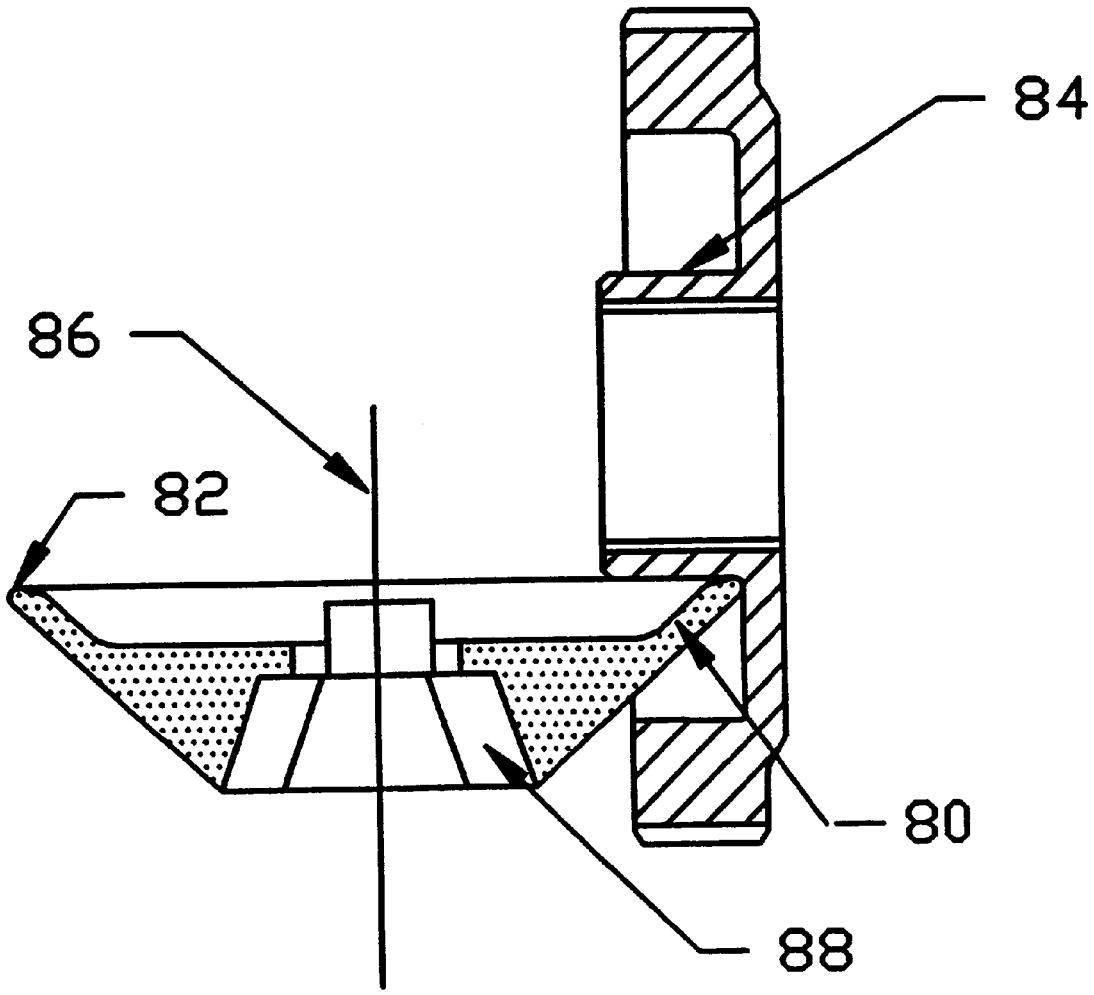

FIG. 10 is a cross-sectional view of FIG. 8 illustrating the use of a conical tool.

Figure 11:
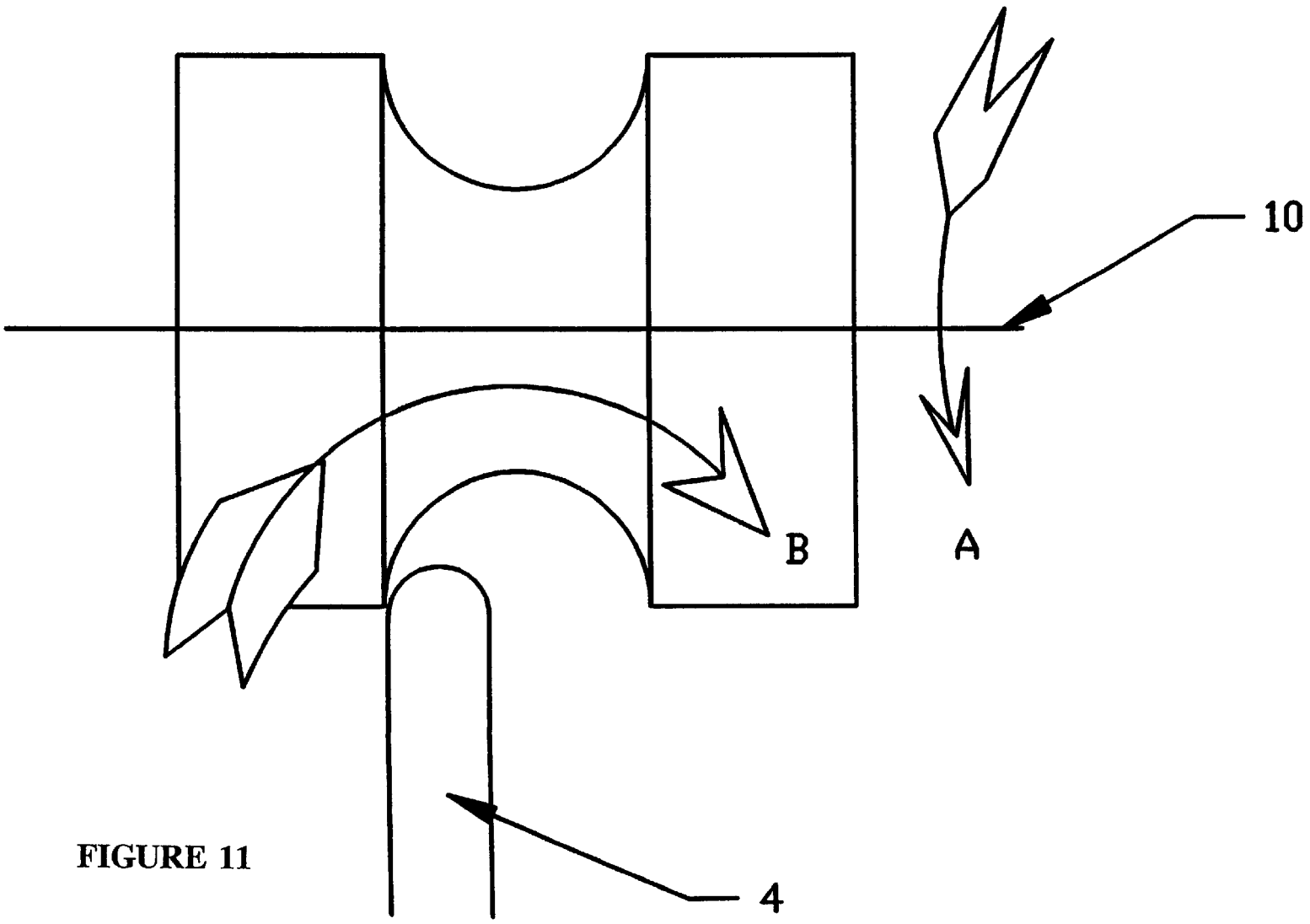

FIG. 11 is a representative drawing of producing a race.

Figure 12:
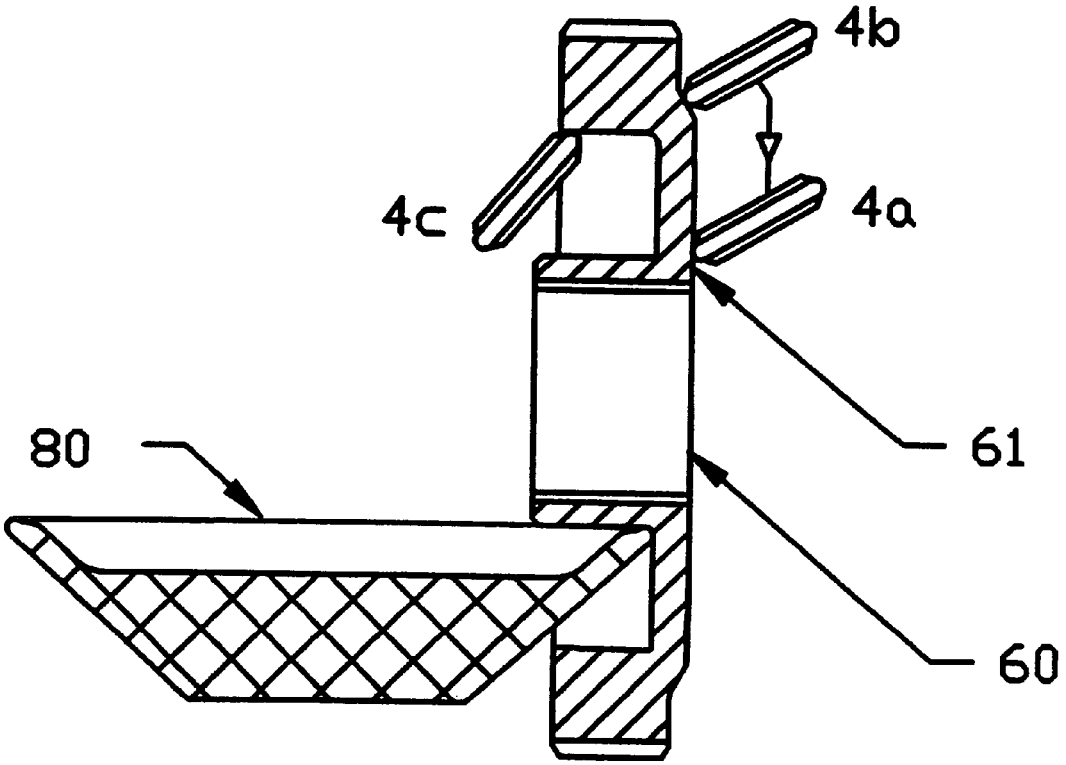

FIG. 12 is a representative drawing of a sprocket gear being densified in a variety of ways in accordance with this invention.

Figure 13:
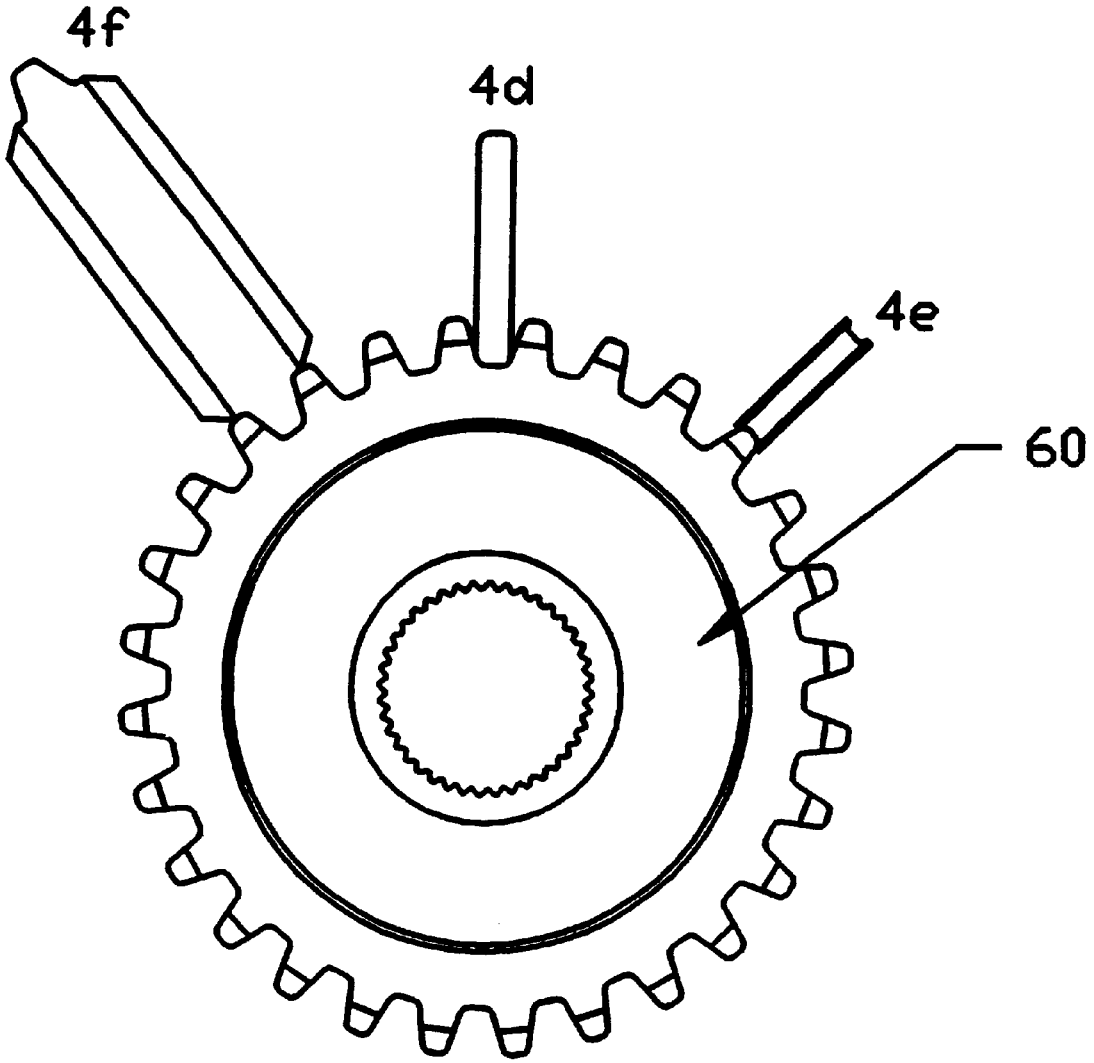

FIG. 13 is a further representative drawing of a sprocket gear being densified.

Figure 14:
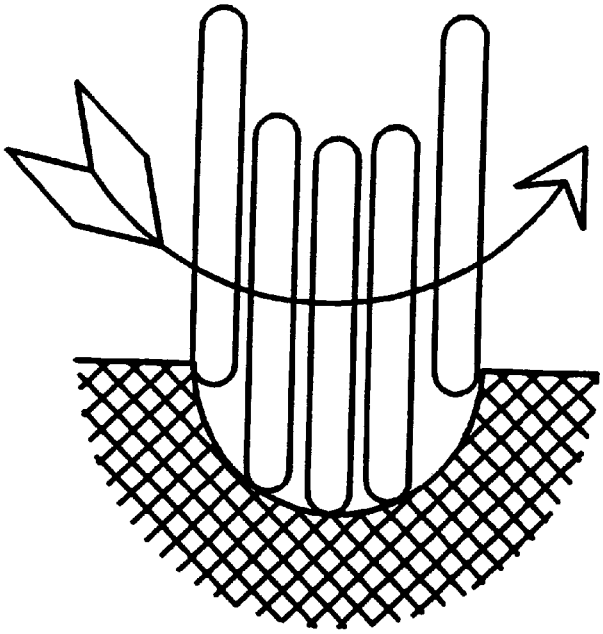

FIG. 14 shows concave densification.

Figure 15:
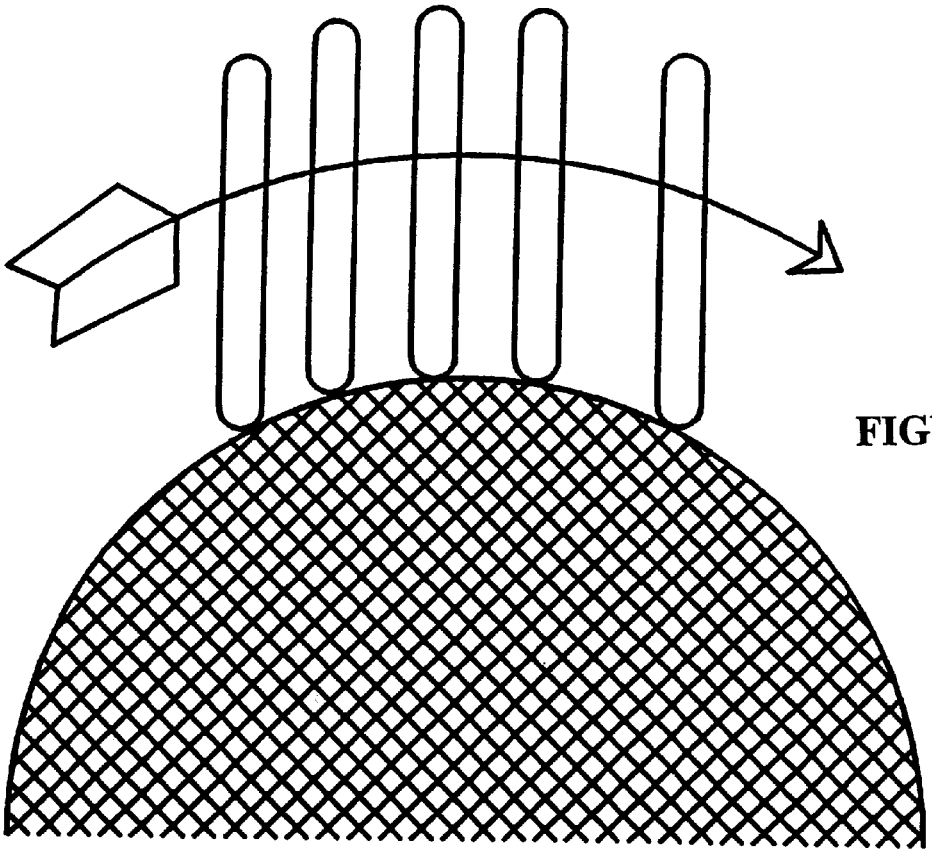

FIG. 15 shows convex densification.

Figure 16:
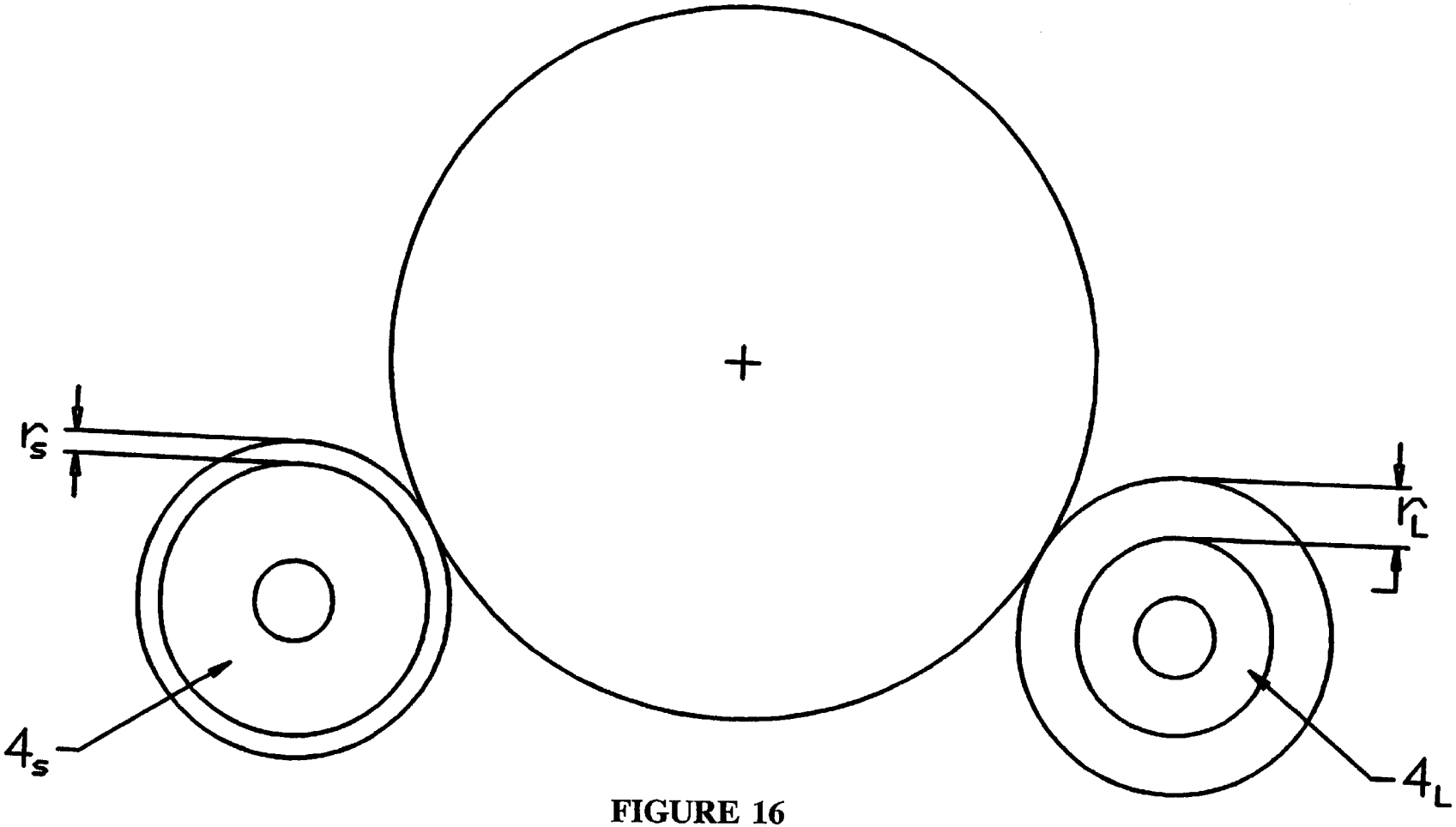

FIG. 16 shows the use of two densifying tools.

FIG. 17 is a chart of radial closure vs depth.

FIG. 18 is a point contact densification limit diagram.

DESCRIPTION OF INVENTION

Like parks will be given like numbers throughout the figures.

Figure 1:
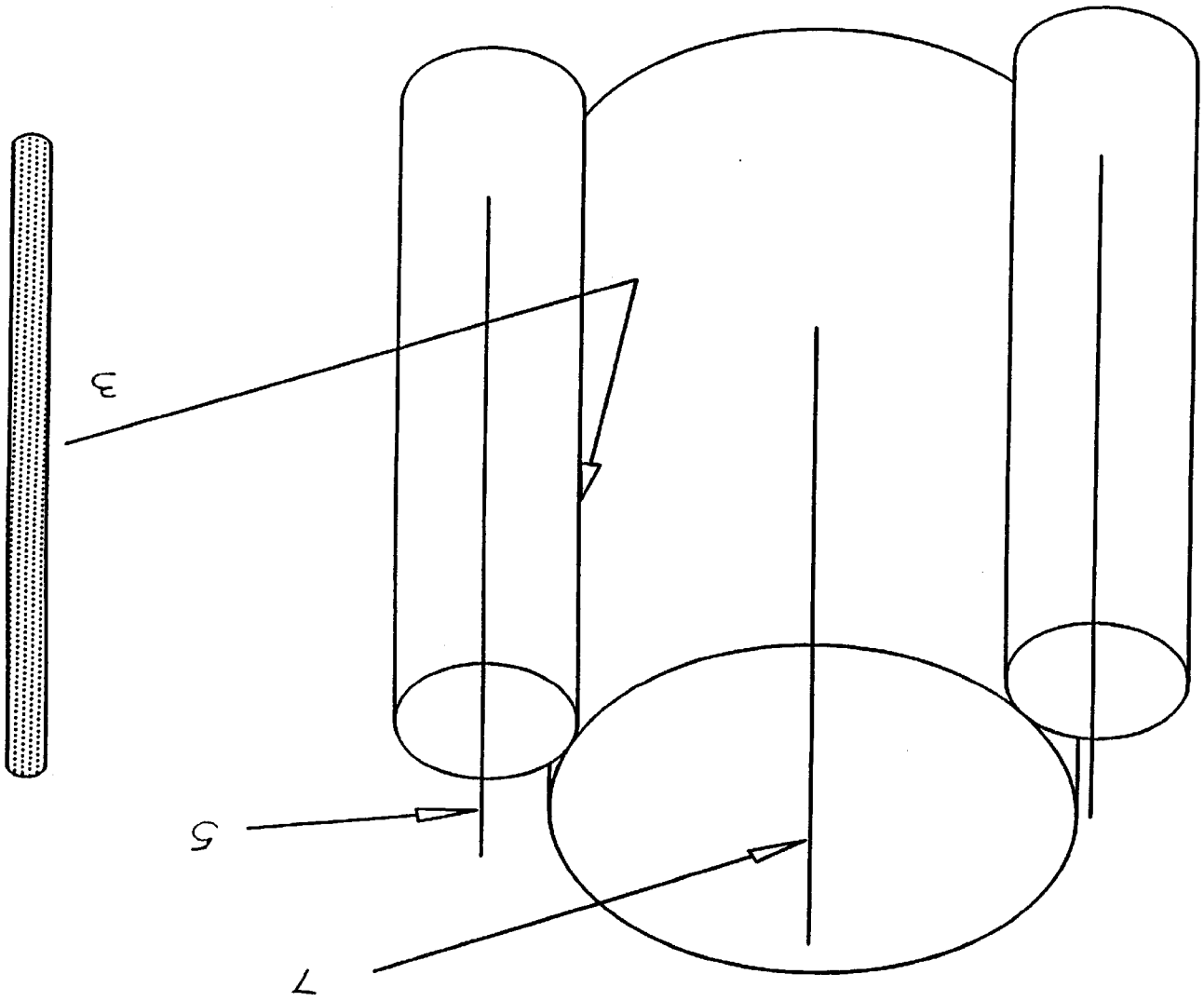
FIG. 1 is a representative drawing of densifying by using rollers along a line of contact.

The durability of powder metal surfaces is generally limited. It has been shown that this durability can be greatly improved by means of a combination of cold work and heat treatment. Such techniques have been extensively covered in the past and include methods of cold working by utilizing line contact tools namely tools that contact the work along a line such as is generally used by rollers. FIG. 1 is a representative view of rollers used to densify along a line of contact 3. When rollers are used to densify along a line it is generally necessary to keep both the axis of rotation, the roller 5 and the workpiece 7 namely the sintered powder metal article parallel so as to optimize such densification. Furthermore high pressures are required to achieve the necessary densification since the pressure must be exerted over a "line 5". Accordingly the requirement of parallel sides and relatively high pressures are disadvantageous as they require more accuracy and lower tool life in order to impart the necessary densification. Furthermore quite often distortion can occur because of the density variation of the workpiece which yields under the stress developed by that processing loads. Such contact area can be minimized by the use of "point contact" to be described heroin.

Figure 3:
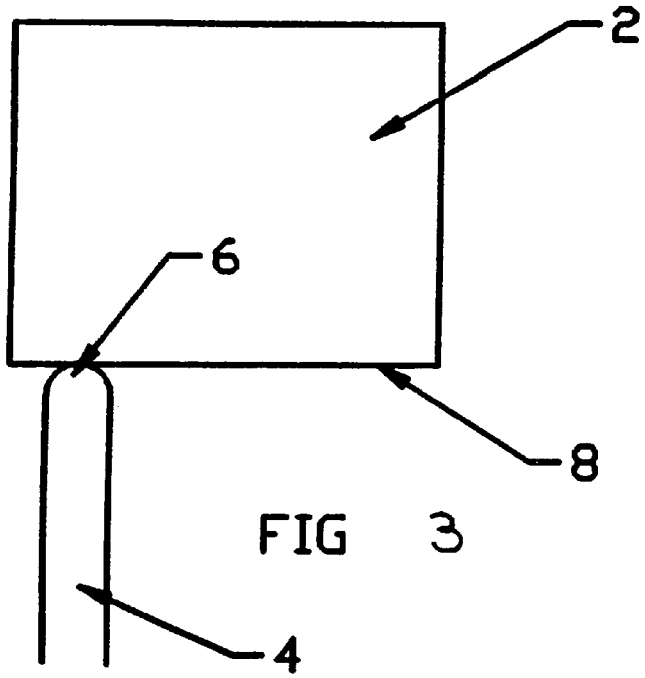
FIG. 3 is a representative view of the work piece and rolling tool.
Figure 4:
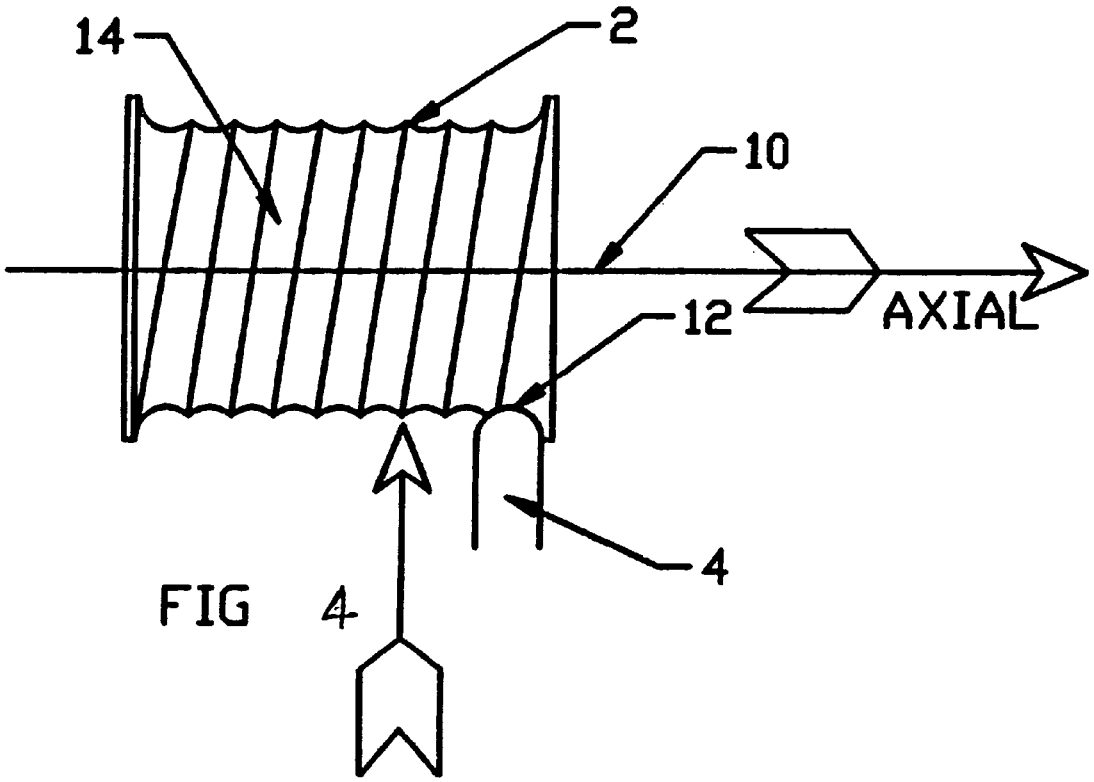
FIG. 4 is a further representative view of the work piece and rolling tool illustrating point contact densification.
Figure 5:
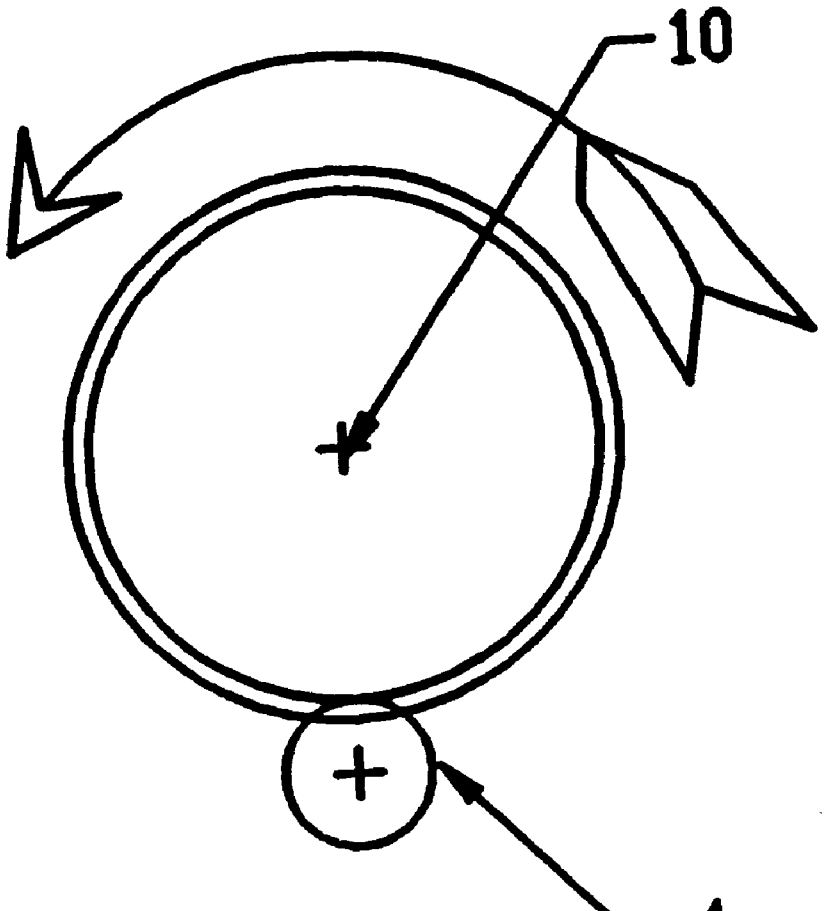
FIG. 5 is an end view of FIG. 2.

FIG. 3 shows a workpiece 2 which generally comprises a sintered powder metal article to be densified by a tool 4 having a radius 6. The radius 6 is used to roll the surface 8 of the workpiece 2. The sintered powder metal article 2 rotates about an axis of rotation 10 in the direction A while at the same time the tool 4 is pressed radially into the surface 8 so as to define a point of contact 12 between the radius 6 and surface 8 and at the same time the tool 4 traverses or moves axially relative the workpiece 2 so as to "scribe" or thread into said article to define a densified surface 14 as shown in FIG. 4.

Figure 2:
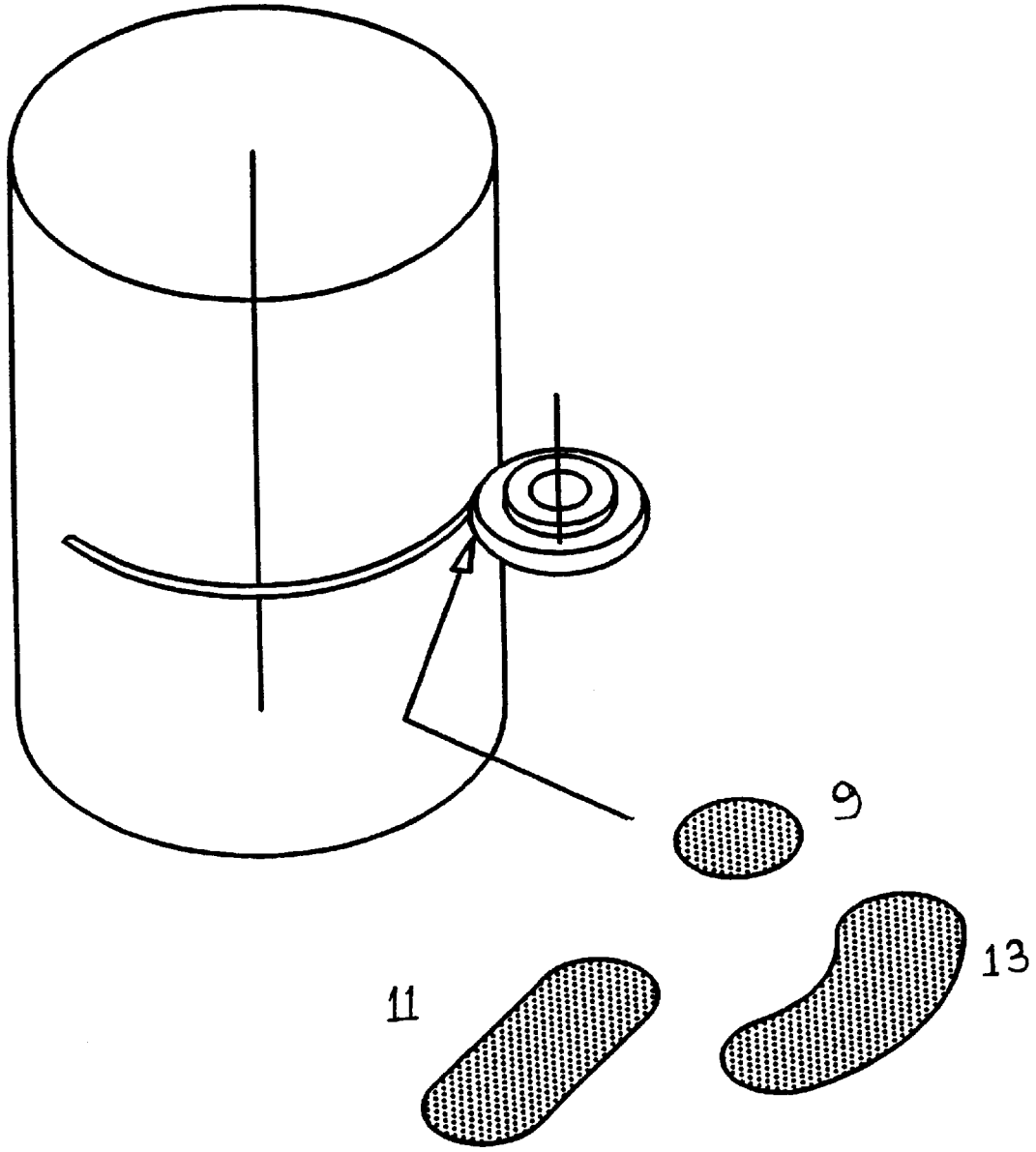
FIG. 2 is a representative view of densing by point contact.

Since the densification occurs as a point or area or region of contact rather than a line of contact lower forces can be utilized which results in longer tool life. FIG. 2 is a representative view of point contact. Under magnification the point of contact between the tool and workpiece 2 may actually appear as a generally round indentation or area 9, elliptical or oval indentation 11 or curved indentation or area 13 (particularly if the hollow cone tool 80 is used).

Accordingly the contact area is minimized by the use of point contact. The radius 6 shown in FIG. 3 is used to roll the surface of the workpiece or sintered powder metal article 2. The geometry that supports the radius and delivers the processing loads can vary according to the application. The simplest form of tool comprises a disc shown in FIGS. 7 and 7A with a radius 6 (as shown as r on the drawings) on the outside diameter 16. The tool 4 can be pressed into the surface 8 of the sintered powder metal article at a suitable depth traversed across the surface densifying as it goes. The point contact tool accordingly presents a radius 6 or point of contact which is free to rotate and is driven by frictional forces. Such process can be carried out dry or wet (by utilizing a lubricant).

FIGS. 6 and 7 illustrate one embodiment of the apparatus which comprises a lathe 50 having a chuck 52 for holding a workpiece such as the gear shown in FIG. 6. The lathe includes a cross slide 54 and compound slide 56 with tool holder 58 holding the tool 4 having the radius 6 or point of contact 6. The tool 4 is adapted for rotational movement within the tool holder 58.

In one embodiment the sintered powder metal article comprises a gear 60 shown in FIG. 8. Such gear 60 may be held in place by the chuck 52 in the manner well known to persons skilled in the art and the compound slide 56, and cross slide 54 adjusted so that the tool 58 will contact the end 62 of the gear 60. Thereafter the tool 4 will be pressed a suitable depth (or closure) into the end face 62 of gear 60. As the chuck 52 with the sintered powder metal article 60 rotates about an axis of rotation 10 the point of contact 6 is pressed against end face 62 so as to scribe a circular region 64 starting from the outside portion of the gear 60 at the same time the tool 4 traverses or is moved radially inwardly towards the axis of rotation so as to define a densified surface 66. In another embodiment of the invention the sintered powder metal article 2 can rotate in the lathe and the tool 58 adjusted so as to present the tool 4 to be radially pressed into the cylindrical surface of the workpiece and densify the surface as shown in FIG. 4.

Alternatively conical surfaces of a powder metal article may be densified by pressing the tool 4 a sufficient depth by radially and axially rotating sintered powder metal article at the same time moving the tool 4 so as to traverse both radially and axially along the conical surface of a sintered powder metal article so as to densify same.

Accordingly the process described herein is well suited for programmable lathes such as CNC machines. Although the invention has been described herein in relation to the lathe shown in FIGS. 6 and 7 other machines can be used so that the tool 4 moves while the workpiece 2 is stationary. For example, the gear 60 shown in FIG. 13 includes root portions 68, flank portions 70 and tip 72. Accordingly the gear 60 may be held stationary and the tool pressed radially into the root portions 68 as shown in FIG. 13 and then the tool 4*d* is traversed across the width 74 of the teeth so as to densify the root regions 68. Apparatus and tools may be designed so that a number of root regions may be simultaneously densified. Alternatively the tools may be stationary and the gear 60 move axially through a series of tools 4. The number of root regions 68 of gear 60 that may be densified will depend on the size of the tools designed. Accordingly the gear or the tools may be indexed so as to rotate and thereby sequentially densify several root regions at once.

Accordingly programmable lathes such as CNC can be used so as to eliminate or produce tapers that are densified or densifying flat faces such as for example thrust faces of a cone.

Furthermore, FIG. 11 illustrates the use of a method so as to produce ball bearing races. Again the workpiece 2 rotates in the direction of rotation A about an axis of rotation 10 and the tool 4 traverses in the direction of B so as to produce a ball bearing race. This method is different from that shown in U.S. Pat. No. 4,059,879 which does not shown the workpiece traversing relative to the rotating workpiece. Furthermore, the invention describe herein does not require use of restraining pressure which was necessary in U.S. Pat. No. 4,059,879.

By utilizing a smaller contact area, smaller rolling forces can be used to thread and densify a surface or alternatively larger contact stresses are generated which can result in larger effective densification when compared with densifying by the use of rollers having a line of contact. Moreover, by point densification each element of material of a workpiece 2 is processed with a minimum number of stress reversals which means that greater densification can be achieved. This can be further enhanced by the use of different radii at the contact point each developing a maximum sheer stress at different depths.

Moreover the method described herein can be applied to nonrotational geometry such as grooves and gear root forms as previously described.

Moreover, thrust faces can be densified and the rolling speed adjusted to maintain efficient action as the tool changes its radius at the contact point.

Moreover, FIG. 10 illustrates the use of a hollow conical tool 80 which presents a point of contact that can be used to thread into the article to define a densified surface namely an internal annual surface 84. Such conical tool 80 rotates about an axis of rotation 86 and sufficient force is generated through the use of bearings 88 so as to densify the surface 84. The point of contact of the conical tool 18 is generated by the rounded circular edge 82 of the conical tool 80. The point of contact or indentation may appear as shown by 13 in FIG. 2.

The process described herein requires that the material being processed have some elasticity and formability. The method can be used as described herein to generate the high pressure and reduce stress cycles and therefore it can be used over a wide range of materials. For example, the powders used for sintering can be either prealloyed powder metal materials, partially prealloyed powder metal materials, substantially pure iron with the addition of ferro alloys, as well as the use of elemental blends which possess unavoidable impurities. Typical powder blends that can be used with the process described herein to produce sintered powder metal articles having the following compositions, namely:

0–0.8% Carbon

0–4.0% Chromium

0–4.0% Manganese

0–4.0% Molybdenum

0–4.0% Nickel

0–4.0% Vanadium

0–4.0% Copper

0–4.0% Silicon

0–1.0% Phosphorous with the remainder being iron and unavoidable impurities.

However, the compositional range described above is included as an example only and not to be construed as being limited in nature.

Accordingly, the method described herein can be used to densify sintered powder metal articles by blending carbon, alloys, iron; pressing said blend so as to produce a compact; sintering said colt to produce a sintered powder metal article; densifying said sintered powder metal article at ambient temperature by relative motion between said article with the tool having a point for pressing and traversing said article to define a densified surface.

Moreover, trust faces can be densified and the rolling speed adjusted to maintain efficient action as the tool changes its radius at the contact point.

Moreover, by utilizing the method herein densities up to 7.8 g/cc can be achieved depending on the depth of pressing (ie the closure) the tool 4 into the worpiece 2. Typically, the closure can be 5 thousandths of an inch.

Furthermore, FIG. 12 is another representative drawing of a sprocket gear 60 being densified in a variety of ways in accordance with the teachings of this invention:

1. the tool 4*a* shows that a face 61 can be densified by traversing the point contact and compensating for rolling speed by CNC programming;
2. the tool 4*b* shows that conical features can be rolled;
3. the rolling tool 80 can be designed to reach into areas where access is limited;
4. the tool 4*c* can be used so that bores and counterbores can be densified;
5. complex features may also be densified as shown in FIG. 13 where tools 4*d*, 4*e* and 4*f* densifies involute tooth, roots and tips, and pitch respectively;
6. curved surfaces such as concave and convex surfaces could be densified as shown in FIGS. 14 and 15 respectively.

The point contact relies on relative motion only so that by the use of a series of tools the process could make use of the part movement relative to the tool; for example progressive densification incorporated into coining. Direction of rotation is not important allowing operations to be simultaneously carried out on the unused side of the workpiece during a turning operation.

Some Advantages of the Invention Described Herein Include:

1. High contact pressures with small applied force means more uniform densification of PM structures.
2. The forces required are brought within range of normal CNC lathe turret forces.
3. Genereally speaking any geometry that can be produced by CNC means can be densified in this way.
4. The process is more controllable because the surface can be machined for precise location, immediately prior to densification.
5. Fewer stress reversals means less "damage" to the structure.
6. Some applications have indicated that the degree of sliding in the tool action is important to the level of densification. This can be controlled by presenting the tool with a pitch or alignment error such as shown by tool 4*a* in FIG. 12 (i.e. the tool is not normal or perpendicular to the axis of the workpiece or face as shown in FIG. 3).
7. The force required to roll a surface can change as the traverse proceeds. This indicates that wrong action is taking place and that the leading radius should be modified. The leading and trailing rolling forces can be balanced by varying the radii at these locations.
8. There is no dwell required as with the case 4 rolling by line contact. For example, if we look at FIG. 2, two rollers we used so that there is a dwell of 180°. By densifying by point contact there is no dwell, and therefore the rates of rolling are much higher than with line contact.
9. The rolling tools are reusable after regrind of the form.
10. The process can be carried out dry because of the fewer number of working parts.
11. The localized closure of porosity can reduce/anticipate heat treatment distortion.
12. By varying the number of rolls and also the progression of radii r at the tips, greater depths of densification can be obtained than that shown in the prior art. This is illustrated in FIG. 16.

For example, two or more tools $\mathbf{4}_L$ and $\mathbf{4}_S$ used are shown in FIG. 16. Generally speaking the larger the radius $r_L$ of a tool $\mathbf{4}_L$ used the greater the depth of densification for the same depth of penetration or closure. However it has been found that if a second tool $\mathbf{4}_S$ is used to densify by point contact after using a tool $\mathbf{4}_{L\ t}$ to densify by point contact the effect or depth densification is greater than if only one tool $\mathbf{4}_S$ was used. It is speculated that the reason for this is that once the surface has been densified by tool $\mathbf{4}_L$ the "pores" in the PM part have been collapsed and therefore the effect of densification of tool $\mathbf{4}_S$ is deeper than if only one tool $\mathbf{4}_S$ was used for the same closure.

EXAMPLE

FIGS. 17 and 18 represent data collected from densifying a sintered powder metal part having a sintered density of 7.0 g/cc which was then point contact densified in accordance with the invention described herein to cause sub-surface densification.

FIG. 17 shows for example that starting from a sintered PM part having a core density of 7.0 g/cc, a radial closure of 0.1 mm would produce a densified sub-surface of 7.8 g/cc to a depth of approximately 0.4 mm.

Furthermore, FIG. 18 is one example of the maximum limit of point contact densification for a particular system. For example, if we use a tool radius of ½ mm and a radial closure of 2 mm (so as to get a product of ½×2=1 $mm^2$) the maximum feed for effective densification is just under 1.4 mm/revolutions. If a tool radius and radial closure is used which produces a value above the curve in FIG. 18 surface exfoliation or surface damage is liable to occur. In other words controls set in excess of the maximum limits generally result in nonuniform, densification and a poor surface finish.

The reference to radial closure could also refer to axial closure if the tool 4 is pressed axially into the workpiece. The tool radius in FIG. 18 refers to r.

Comments on Densification (for material at 7.0 g/cc with 0.4% C) as shown in FIG. 18

Can achieve 0.005" radial closure in one pass.

Can achieve 0.0015" radial closure with multiple passes.

Maximum closure per pass—fixed by densification limit diagram.

The use of multiple passes generally improves the level of densification. However, too many multiple passes may cause surface exfoliation (up to around 0.004" depth). The rolling damage which may occur can often be offset by annealing before rolling.

Depth of densification is directly related to radial closure—see graph.

There is some small dependence of tool radius (R as shown in FIG. 7) on densification depth—a smaller radius r promotes improved densification characteristics.

Effects of Material Condition (density carbon/alloy level)

Core density is expected to play a large role on closure-densification characteristics.

Carbon and alloy composition will have a minor effect densification characteristics.

Carbon and alloy composition may affect maximum absolute closure/densification levels due to inherent material plasticity and fatigue resistance.

Subsequent Heat Treatment

Subsequent heat treatment will likely be required as in the case of densifying by line contact to optomize durability of the part.

Although the preferred embodiment as well as the operation and use have been specifically described in relation to the drawings, it should be understood that variations in the preferred embodiment could be achieved by a person skilled in the trade without departing from the spirit of the invention as claimed herein.

The embodiments of the invention in which an exclusive property or privilege is claimed are defined as follows:

1. A method of densifying a sintered powder metal article with a tool having contact with said article having a surface wherein said tool and said article are relatively moved radially and axially while said tool compacts said surface to form a thread into said article to define a densified surface.

2. A method as claimed in claim 1 wherein said tool and said article are moved in a circular motion.

3. A method as claimed in claim 2 wherein said sintered powder metal article rotates relative said tool.

4. A method as claimed in claim 3 wherein said tool is radially pressed into said sintered powder metal article and moved axially relative said article during rotation.

5. A method as claimed in claim 2 wherein said rotating sintered powder metal article defines an axis of rotation and said tool is pressed radially into and is axially moved relative said article during said rotation of said article to form said thread into said article to define said densified surface.

6. A method as claimed in claim 4 wherein said rotating sintered powder metal article defines an axis of rotation and said tool is pressed axially into and radially moved relative said article during said rotation of said article to form said thread into said article to define said densified surface.

7. A method as claimed in claim 5 wherein said rotating sintered powder metal article defines an axis of rotation and said tool is pressed axially and radially into said article during revolution of said article to define a densified surface.

8. A method as claimed in claim 4 wherein said tool comprises a rotating disc presenting a rotatable rounded peripheral edge defining a tool radius in contact with said powder metal article, wherein said movement of said tool relative said article per revolution during rotation is less than tool radius so as to define said densified surface.

9. A method of densifying a sintered powder metal article having a surface with a tool having contact with said article wherein said tool and said article are relatively moved in a first and second direction while said tool compacts said surface to form a thread into said article to define a densified surface.

10. A method as claimed in claim 9 wherein said tool is axially pressed in said first direction into said article and radially traverses said article in said second direction during relative rotation so as to define a densified end surface of said article.

11. A method as claimed in claim 9 wherein said tool is radially pressed into said article in said first direction and axially traverses said article in said second direction during relative rotation so as to densify a cylindrical surface of said article.

12. A method as claimed in claim 9 wherein said tool radius is radially and axially pressed into said article in said first direction and traverses across said article in said second direction so as to densify a conical surface of said article.

13. A method of densifying a sintered powder metal article comprising:

(a) blending
  (i) carbon
  (ii) alloys
  (iii) iron (b) pressing said blend so as to produce a compact;

(c) sintering said compact to produce a sintered powder metal article having a surface;

(d) densifying said sintered powder metal article at ambient temperature by relative motion between said article with a tool having a point for pressing into said article in a first direction and traversing said article in a second direction during said relative motion while said tool compacts said surface so as to form a thread into said article to define a densified surface.

14. A method as claimed in claim 13 wherein said sintered powder metal article comprises between:

0–0.8% C
0–4.0% Cr
0–4.0% Mn
0–4.0% Mo
0–4.0% Ni

0–4.0% V

0–4.0% Cu

0–4.0% Si

0–1% P and the remainder essentially iron and unavoidable impurities.

15. Apparatus for densifying a sintered powder metal article having a surface comprising;

(a) a tool having a rounded peripheral edge defining a point for contacting said sintered powder metal article;

(b) means for generating relative motion between said tool and said article for pressing said tool into said article in a first direction and traversing said article in a second direction during said relative motion while said tool compacts said surface to form a thread into said article to define a densified surface.

16. Apparatus as claimed in claim 15 wherein said article comprises a gear having teeth defining root, flank and tip regions and said point densifies said root regions.

17. Apparatus as claimed in claim 15 wherein said tool comprises a hollow cone having a peripheral edge for pressing into said sintered powder metal article so as define a point of contact for densifying said sintered powder metal article.

18. A method as claimed in claim 9 wherein said tool is pressed into said article five thousandths of an inch.

19. A method as claimed in claim 9 wherein said tool is preripheral edge defining a tool radius.

20. A method as claimed in claim 19 including a second tool having a tool radius different from said first tool radius.

* * * * *